US009149814B2

(12) United States Patent
Kouznetsov

(10) Patent No.: US 9,149,814 B2
(45) Date of Patent: Oct. 6, 2015

(54) COMPOSITION AND METHOD FOR IMPROVEMENT IN FROTH FLOTATION

(71) Applicant: Ecolab USA Inc., Naperville, IL (US)

(72) Inventor: Dmitri L. Kouznetsov, Aurora, IL (US)

(73) Assignee: ECOLAB USA INC., Naperville, IL (US)

( * ) Notice: Subject to any disclaimer, the term of this patent is extended or adjusted under 35 U.S.C. 154(b) by 393 days.

(21) Appl. No.: 13/798,965

(22) Filed: Mar. 13, 2013

(65) Prior Publication Data

US 2014/0262974 A1 Sep. 18, 2014

(51) Int. Cl.

| | |
|---|---|
| ***B03D 1/02*** | (2006.01) |
| ***B03D 1/016*** | (2006.01) |
| ***B03D 1/008*** | (2006.01) |
| ***B03D 1/004*** | (2006.01) |
| *B03D 1/006* | (2006.01) |
| *B03D 1/01* | (2006.01) |
| *B03D 1/012* | (2006.01) |
| *B03D 1/014* | (2006.01) |

(52) U.S. Cl.

CPC ..... *B03D 1/004* (2013.01); *B03D 1/016* (2013.01); *B03D 1/02* (2013.01); *B03D 1/006* (2013.01); *B03D 1/008* (2013.01); *B03D 1/01* (2013.01); *B03D 1/012* (2013.01); *B03D 1/014* (2013.01); *B03D 2201/02* (2013.01); *B03D 2203/08* (2013.01)

(58) Field of Classification Search

None

See application file for complete search history.

(56) References Cited

U.S. PATENT DOCUMENTS

| | | | | |
|---|---|---|---|---|
| 3,172,892 | A | 3/1965 | LeSuer | |
| 3,219,666 | A | 11/1965 | Norman | |
| 3,272,746 | A | 9/1966 | LeSuer | |
| 3,445,386 | A | 5/1969 | Otto | |
| 3,819,660 | A | 6/1974 | Cahill | |
| 3,912,764 | A | 10/1975 | Palmer, Jr. | |
| 4,110,349 | A | 8/1978 | Cohen | |
| 4,564,369 | A * | 1/1986 | Burgess et al. | 44/629 |
| 4,589,980 | A | 5/1986 | Keys | |
| 4,756,823 | A | 7/1988 | O'Neill et al. | |
| 5,041,622 | A | 8/1991 | LeSuer | |
| 5,173,176 | A | 12/1992 | Klimpel et al. | |
| 5,304,317 | A | 4/1994 | Barwise et al. | |
| 5,379,902 | A | 1/1995 | Wen et al. | |
| 6,827,220 | B1 | 12/2004 | Young et al. | |
| 7,553,984 | B2 | 6/2009 | Rau et al. | |
| 8,093,303 | B2 | 1/2012 | Hovland et al. | |
| 8,123,042 | B2 | 2/2012 | Tran | |
| 8,242,287 | B2 | 8/2012 | Schertzer et al. | |
| 2003/0146134 | A1 | 8/2003 | Yoon | |
| 2010/0181520 | A1 | 7/2010 | Gupta et al. | |
| 2011/0198296 | A1 | 8/2011 | Child | |

FOREIGN PATENT DOCUMENTS

| | | | |
|---|---|---|---|
| GB | 2163975 A | * | 3/1986 |
| WO | 2007098115 A2 | | 8/2007 |

OTHER PUBLICATIONS

International Search report mailed Jul. 3, 2014 for related international application No. PCT/US2014/016003 filed Feb. 12, 2014.

* cited by examiner

*Primary Examiner* — Thomas M Lithgow

(74) *Attorney, Agent, or Firm* — Benjamin Carlsen

(57) ABSTRACT

The invention provides methods and compositions for improving a froth flotation type separation. The method involves adding a hydrocarbon reaction product to slurry to enhance the separation. The method is particularly effective with coal separation because it increases yield without increasing ash content of flotation concentrate.

6 Claims, 4 Drawing Sheets

COMPOSITION AND METHOD FOR IMPROVEMENT IN FROTH FLOTATION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to novel methods, compositions, and apparatuses for improving the effectiveness of froth flotation beneficiation processes. In a beneficiation process, two or more materials which coexist in a mixture (the fines) are separated from each other using chemical and/or mechanical processes. Often one of the materials (the beneficiary) is more valuable or desired than the other material (the gangue).

As described for example in U.S. Pat. Nos. 4,756,823, 5,304,317, 5,379,902, 7,553,984, 6,827,220, 8,093,303, 8,123,042, and in Published US Patent Applications 2010/0181520 A1 and 2011/0198296, one form of beneficiation is froth flotation separation. In froth flotation separation the fines are mixed with water to form slurry. The slurry is then sparged to form bubbles which rise up out of the slurry. The more hydrophobic material (the concentrate) adheres to and rises up with the bubbles and gathers in a froth layer above the slurry. The froth layer is then is deposited on a launder where the concentrate gathers. The less hydrophobic material (the tailings) remains behind in the slurry.

Two common forms of flotation separation processes are direct flotation and reverse flotation. In direct flotation processes, the concentrate is the beneficiary and the tailings are the gangue. In reverse flotation processes, the gangue constituent is floated into the concentrate and the beneficiary remains behind in the slurry. The object of the flotation is to separate and recover as much of the valuable constituent(s) of the fine as possible in as high a concentration as possible which is then made available for further downstream processing steps.

Froth flotation separation can be used to separate solids from solids (such as the constituents of mine ore) or liquids from solids or from other liquids (such as the separation of bitumen from oil sands). When used on solids, froth separation also includes having the solids comminuted (ground up by such techniques as dry-grinding, wet-grinding, and the like). After the solids have been comminuted they are more readily dispersed in the slurry and the small solid hydrophobic particles can more readily adhere to the sparge bubbles.

There are a number of additives that can be added to increase the efficiency of a froth flotation separation. Collectors are additives which adhere to the surface of concentrate particles and enhance their overall hydrophobicity. Gas bubbles then preferentially adhere to the hydrophobicized concentrate and it is more readily removed from the slurry than are other constituents, which are less hydrophobic or are hydrophilic. As a result, the collector efficiently pulls particular constituents out of the slurry while the remaining tailings which are not modified by the collector, remain in the slurry. This process can also or instead utilize chemicals, which increase the hydrophilic properties of materials selected to remain within the slurry. Examples of collectors include kerosene, diesel fuel, oily products such as fuel oil, tar oil, animal oil, and hydrophobic polymers. Other additives include frothing agents, regulators, depressors (deactivators) and/or activators, which enhance the selectivity of the flotation step and facilitate the removal of the concentrate from the slurry.

Unfortunately a number of these collectors are either prohibitively expensive or require such massive volumes that they are impractical as "workhorse" type collectors. Thus it is clear that there is definite utility in improved methods, compositions, and apparatuses for use as collectors in froth separation slurry. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

To satisfy the long-felt but unsolved needs identified above, at least one embodiment of the invention is directed towards a method of enhancing the performance of a froth flotation separation of slurry in a medium. The method comprises the steps of: i) adding to the slurry a composition, the composition comprising a hydrophobic reaction product, a surfactant, ii) optionally a diluent and optionally a coupling agent, and iii) removing concentrate from the slurry by sparging the slurry. The slurry may contain comminuted coal.

The hydrophobic reaction product is the result of a reaction of a moiety which is a unsaturated mono- and polycarboxylic acids, their precursors, anhydrides, acyl halides, salts, amides, esters, or blends thereof with at least one of an unsaturated fatty acid or unsaturated fatty ester of natural origin, an unsaturated fatty acid or unsaturated fatty ester of synthetic origin, including triglyceride oils, and at least one of a polyolefin with the molecular weight in the range from about 400 to about 10,000 Daltons.

The moiety may be at least one of: lauroleic, myristoleic, palimitoleic, oleic, erucic, maleic, fumaric, glutaconic, citraconic, mesaconic, aconitic, and itaconic acid, 5-norbornene-2,3-dicarboxylic acid, 1,2,3,6-tetrahydrophthalic acid, esters thereof, anhydrides, acyl halides and esters thereof, or blends thereof, and any combination thereof. The fatty acids may be selected from the list consisting of C6-C24 unsaturated fatty acids with a straight or branched carbon chains, palmitoleic, oleic, linoleic, linolenic, ricinoleic, eleostearic, docosahexaenoic acids, eicosapentaenoic acid, and any combination thereof.

The hydrophobic reaction product may be one selected from the list consisting of: maleinized linseed oil polymer, heat polymerized linseed oil, oligomeric acids prepared from tall oil, and any combination thereof. The hydrophobic reaction product may be produced by reacting unsaturated polycarboxylic acids, esters thereof, anhydrides, acyl halides and esters thereof, or combination thereof with olefin polymers. The olefin polymers may be one selected from the list consisting of any isomer of ethylene, propylene, 1-butene, 2-butene, isobutene, pentenes, hexenes and heptenes, and any combination thereof and may include or comprise polyisobutenyl succinic anhydrides. The surfactant may be one of: fatty alcohol polyglycol ethers, alkylphenol polyglycol ethers, fatty acid polyglycol esters, fatty acid amide polyglycol ethers, fatty amine polyglycol ethers, alkoxylated triglycerides, alk(en)yl oligoglucosides, fatty acid-N-alkyl glucamides, protein hydrolyzates (more particularly soya-based vegetable products), polyol fatty acid esters, sugar esters, sorbitan esters and polysorbates, polyoxyethylene alkyl ethers, polyoxyethylene alkylphenyl ethers, ether esters, polyethyleneglycerol fatty acid esters; polyethyleneglycol fatty acid esters, and any combination thereof.

The diluent or coupling agent may be one item selected from the group consisting of: of solvatropes, coupling agents, water and oil miscible organic solvents, alcohols, ketones, carboxylic acids, esters of carboxylic acids, aliphatic, aromatic, terpenic, paraffinic, isoparaffinic and olefinic hydrocarbons, alcohols and glycol ethers, and any combination thereof.

The method may further comprising the steps of: iv) mixing the composition with a base liquid in a manner that forms a desired ratio of composition to base liquid, prior to adding it to slurry, v) measuring the rate of the concentrate removal, and vi) adjusting the ratio to increase the rate of the concentrate removal.

Additional features and advantages are described herein, and will be apparent from, the following Detailed Description.

BRIEF DESCRIPTION OF THE DRAWINGS

A detailed description of the invention is hereafter described with specific reference being made to the drawings in which.

For the purposes of this disclosure, like reference numerals in the figures shall refer to like features unless otherwise indicated. The drawings are only an exemplification of the principles of the invention and are not intended to limit the invention to the particular embodiments illustrated.

DETAILED DESCRIPTION OF THE INVENTION

Figure 1:
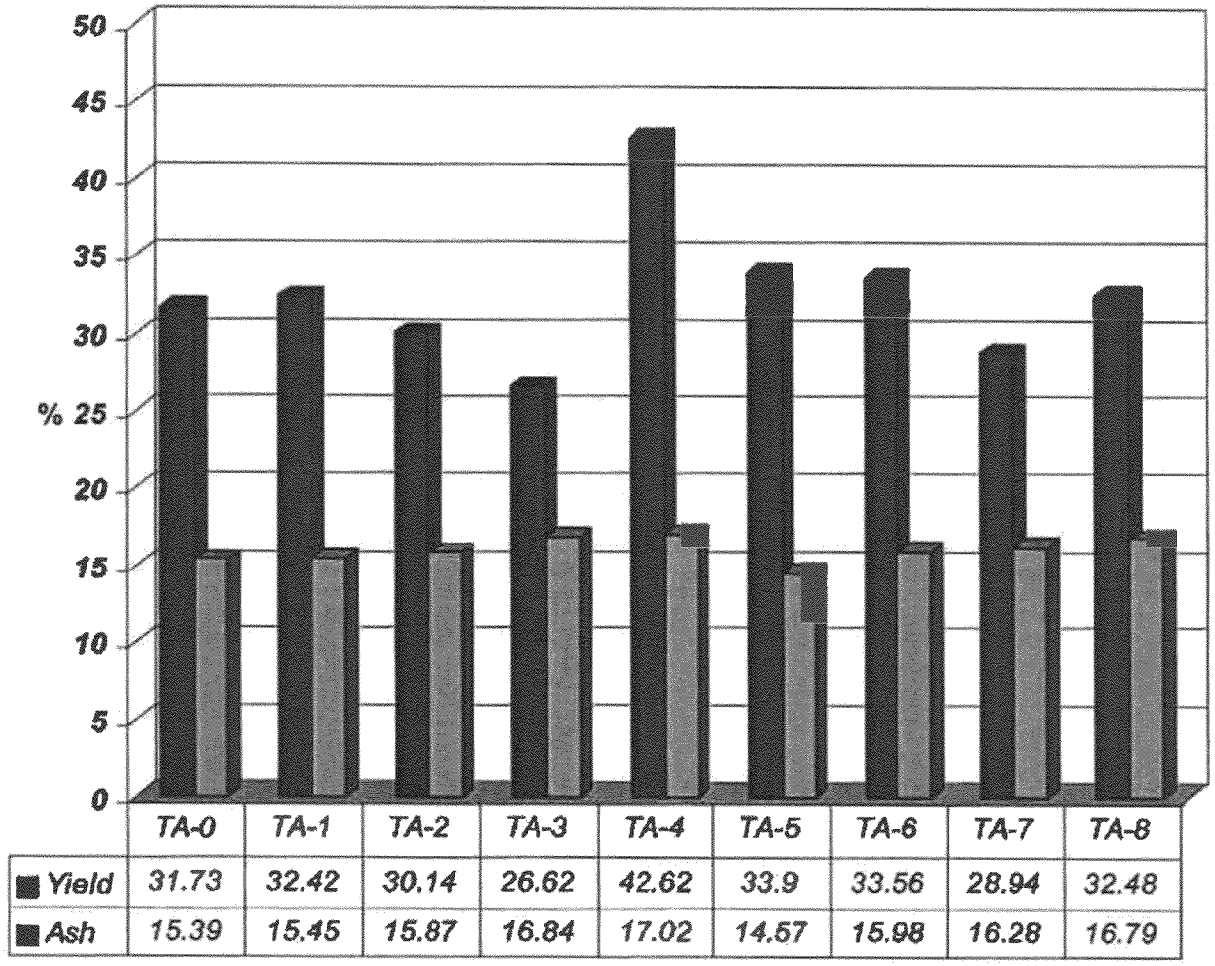
FIG. 1 is graph illustrating the effectiveness of the invention.

The following definitions are provided to determine how terms used in this application, and in particular how the claims, are to be construed. The organization of the definitions is for convenience only and is not intended to limit any of the definitions to any particular category.

"Collector" means a composition of matter that selectively adheres to a particular constituent of the fine and facilitates the adhesion of the particular constituent to the micro-bubbles that result from the sparging of a fine bearing slurry.

"Comminuted" means powdered, pulverized, ground, or otherwise rendered into fine solid particles.

"Concentrate" means the portion of fine which is separated from the slurry by flotation and collected within the froth layer.

"Consisting Essentially of" means that the methods and compositions may include additional steps, components, ingredients or the like, but only if the additional steps, components and/or ingredients do not materially alter the basic and novel characteristics of the claimed methods and compositions.

"Fine" means a composition of matter containing a mixture of a more wanted material, the beneficiary and a less wanted material, the gangue.

"Frother" means a composition of matter that enhances the formation of the micro-bubbles and/or preserves the formed micro-bubbles bearing the hydrophobic fraction that result from the sparging of slurry.

"HLB" means the hydrophillic-lipophillic balance of an emulsifier which is a measure of the degree to which it is hydrophilic or lipophilic, it can be determined by the equation:

$$HLB=20*Mh/M$$

in which Mh is the molecular mass of the hydrophilic portion of the Molecule, and M is the molecular mass of the whole molecule, giving a result on a scale of 0 to 20. An HLB value of 0 corresponds to a completely lipophilic/hydrophobic molecule, and a value of 20 corresponds to a completely hydrophilic/lipophobic molecule. HLB values are characterized as:

HLB<10: Lipid soluble (water insoluble)
HLB>10: Water soluble (lipid insoluble)
HLB from 4 to 8 indicates an anti-foaming agent
HLB from 7 to 11 indicates a W/O (water in oil) emulsifier
HLB from 12 to 16 indicates O/W (oil in water) emulsifier
HLB from 11 to 14 indicates a wetting agent
HLB from 12 to 15 indicates a detergent
HLB of 16 to 20 indicates a solubiliser or hydrotrope.

"Promoter" means an ingredient designed to increase performance of a collector.

"Slurry" means a mixture comprising a liquid medium within which fines (which can be liquid and/or finely divided solids) are dispersed or suspended, when slurry is sparged, the tailings remain in the slurry and at least some of the concentrate adheres to the sparge bubbles and rises up out of the slurry into a froth layer above the slurry, the liquid medium may be entirely water, partially water, or may not contain any water at all.

"Surfactant" is a broad term which includes anionic, nonionic, cationic, and zwitterionic surfactants. Enabling descriptions of surfactants are stated in *Kirk-Othmer, Encyclopedia of Chemical Technology*, Third Edition, volume 8, pages 900-912, and in *McCutcheon's Emulsifiers and Detergents*, both of which are incorporated herein by reference.

"Sparging" means the introduction of gas into a liquid for the purpose of creating a plurality of bubbles that migrate up the liquid.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the Kirk-Othmer Encyclopedia of Chemical Technology, 5th Edition, (2005), (Published by Wiley, John & Sons, Inc.) this definition shall control how the term is to be defined in the claims.

In at least one embodiment a froth flotation separation process is enhanced by the addition to the slurry of an inventive composition. The inventive composition comprises three ingredients: 1) a hydrophobic reaction products derived from organic substrates of natural and synthetic origin. The hydrophobic reaction product may comprise between 60-95% of the composition, 2) one or more surfactants. The surfactant(s) may comprise between 0.1-40% of the composition. 3) One or more diluent and/or coupling agents. The diluent and/or coupling agent may comprise between 5-40% of the composition.

In at least one embodiment the hydrophobic reaction products suitable as Ingredient 1 can be prepared by reacting (A1) unsaturated mono- and polycarboxylic acids, their precursors, esters thereof, anhydrides thereof, acyl halides and esters thereof, salts, amides, esters, or blends thereof with at least one of the following:

(A2) Unsaturated fatty acids and esters thereof of natural or synthetic origin including triglyceride oils and/or (A3) Polyolefins with the molecular weight in the range from about 400 to about 10,000 Daltons.

In at least one embodiment the unsaturated carboxylic acids (A1) contain at least one replaceable hydrogen atom per molecule. The preferable are such unsaturated monocarboxylic acids as lauroleic, myristoleic, palimitoleic, oleic, and erucic. The suitable polycarboxylic acids are maleic acid, fumaric acid, glutaconic acid, citraconic acid, mesaconic acid, aconitic acid and itaconic acid, 5-norbornene-2,3-dicarboxylic acid, 1,2,3,6-tetrahydrophthalic acid, their precursors, esters thereof, anhydrides, acyl halides and esters thereof, or blends thereof.

Fatty acids (A2) may include C6-C24 unsaturated fatty acids with a straight or branched carbon chain. Particularly preferable are palmitoleic, oleic, linoleic, linolenic, ricinoleic, eleostearic, docosahexaenoic acids, elcosapentaenoic acid, and the likes. Any combination of the unsaturated monobasic acids listed above may be used. In the synthesis of the instant materials, the fatty acids can also be used as their esters with C1-C4 alcohols, including but not limited to methyl ester or ethyl esters. Additionally, natural esters of the fatty acids can be utilized as Reactant A2, which include crude or processed triglyceride oils of vegetable or animal origin such as soybean oil, linseed oil, castor oil, dehydrated castor oil, corn oil, safflower oil, sunflower oil, canola oil, fish oils, lard oil, beef oil, oiticica oil, tung oil, and tall oil, or their combinations. The usefulness of the fatty acids and oils is directly related to the density of double-bond in the fatty acid chains.

In at least one embodiment the hydrophobic compounds are produced by the reaction of maleic anhydride with unsaturated fatty acids or esters thereof including triglyceride oils of vegetable and animal origin. Such maleinization reaction is well known to those skilled in the art to form a condensation product in the presence of heat and/or pressure. Depending on the amount of the anhydride reacted, maleinization may proceed in several steps. The addition of the first mole of the anhydride may proceed through an "ene" reaction, which may result in the addition of a succinic anhydride group to the allylic functionality of the fatty chain. For the oils (and fatty acids) having more than one double bond in the fatty chains, such as linseed or soybean oil, the first step may be followed by rearrangement of the double bonds of the fatty chain into a conjugated system and addition of the second mole of the anhydride through Diels Alder reaction. Additionally, elevated temperatures may also cause a direct intermolecular "ene" and Diels Alder reactions between the fatty acid chains of triglyceride oils (particularly, natural oils rich in polyunsaturated carbon chains such as linseed, tung, and fish oils). Such "ene" and Diels Alder reactions can further cross-link the unsaturated fatty acid fragments forming saturated or unsaturated rings of five or six atoms, which improves promoter performance of the instant materials. Examples of ene reactions and materials produced therefrom are described in U.S. Pat. Nos. 3,819,660, 3,219,666, 3,172,892, 3,272,746, and 8,242,287.

While preparing the hydrophobic products of the instant invention, the reaction conditions can also be set to induce direct intermolecular and intramolecular "ene" reactions between mono- and poly-unsaturated monocarboxylic acids such as those in tall oil—a byproduct of the Kraft process of wood pulp manufacture. These ene reactions can cross-link the unsaturated fatty acid fragments to form useful dimeric, trimeric, and other oligomeric species, or in the case of polyunsaturated fatty acid fragments—oligomeric and polymeric species containing saturated or unsaturated rings of five or six atoms, which was found to improve the effect of instant materials on flotation.

The "ene" and Diels Alder reaction products may be further cross-linked to create even higher molecular weight species useful in the present invention. Such cross-linking may be accomplished through the esterification of the carboxylic functionalities with polyols. For this purpose, mono-, di-, and tri-glycerol, pentaerythritol, sorbitol, polyvinyl alcohol, alpha-methyl-O-glucoside and polyallyl alcohol can be used by those skilled in the art. The useful polyols may be bifunctional glycols or poly(alkylene) glycols derived from at least one unit selected from but not limited to the group of ethylene oxide, propylene oxide, butylene oxide, pentylene oxide, and hexylene oxide, and any combination thereof.

An example of a material prepared by the above method is the Falkwood 51 YZ maleinized linseed oil polymer from Cargill, Inc. Another example of the suitable materials are the VOM 25 and VOS 70 heat polymerized linseed oils, also from Cargill, Inc. Further examples of the suitable material are Unidyme and Century oligomeric acids prepared from tall oil available from Arizona Chemical.

Finished hydrophobic materials of the present invention may be comprised from about 50% to 90% of the species having an average molecular weight from 500 to 10,000 Daltons and from about 10% to 50% of the species with a molecular weight in the range from 10,000 to 100,000 Daltons as determined by gel permeation chromatography.

In at least one embodiment the hydrophobic materials can be produced by reacting unsaturated polycarboxylic acids A1 with olefin polymers (A3).

Suitable olefin polymers may be prepared by polymerization of olefins containing up to 7 carbon atoms. Polymers derived from both monoolefins and diolefins can be utilized. Suitable monoolefins include ethylene, propylene, 1-butene, 2-butene, isobutene and the pentenes, hexenes and heptenes (all isomers included). The diolefins may be conjugated or nonconjugated; suitable conjugated diolefins include butadienes, isoprene, 1,3-pentadiene and 1,3-hexadiene, and suitable nonconjugated diolefins include 1,4-pentadiene, 1,4-hexadiene and 1,5-hexadiene, and any combination thereof.

Suitable polymers are those derived from monoolefins, especially mono-1-olefins and more especially C2-6 mono-1-olefins such as ethylene, propylene and the butenes, and any combination thereof. Homopolymers and interpolymers are suitable, and the interpolymers may be ordinary chain interpolymers or graft interpolymers. The preferred polymers are homopolymers and interpolymers derived from mixtures of monomers differing in size by at most about two carbon atoms, such as ethylene-propylene interpolymers and the polybutenes more fully described hereinafter.

Suitable olefin polymers can contain minor proportions of alicyclic or aromatic carbon atoms which may be derived from such monomers as cyclopentene, cyclohexene, methylene cyclopentene, methylene cyclohexene, 1,3-cyclohexadiene, norbornene, norbornadiene, cyclopentadiene, styrene and α-methylstyrene, and any combination thereof.

The olefin polymer may contain about 30-300 and preferably about 50-250 carbon atoms. The number average molecular weight of the polymer, as determined by gel permeation chromatography, is ordinarily about 420-10,000, especially about 700-5,000 and more especially about 750-3,000.

A particularly preferred class of olefin polymers comprises the polybutenes, which are prepared by polymerization of one or more of 1-butene, 2-butene and isobutene. Especially desirable are polybutenes containing a substantial proportion of units derived from isobutene. The polybutene may contain minor amounts of butadiene which may or may not be incorporated in the polymer. Most often the isobutene units constitute 80%, preferably at least 90%, of the units in the polymer. These polybutenes are readily available commercial materials.

In at least one embodiment the materials produced using olefin polymers (A3) are polyisobutenyl succinic anhydrides (PIBSA) as described, for example, in U.S. Pat. Nos. 3,445,386, 3,912,764, 4,110,349, and 5,041,622 incorporated by reference herein. Such materials, for example, derived from 1000 and 1300 molecular weight polybutenes are available from the Chevron Oronite Company, TX, under the trade names OLOA 15500 and OLOA 15667, respectively. Suitable PIBSA materials are also available from the Lubrizol Corporation, OH, under the trade names Addconate H, Addconate S, Lubrizol 5620, and others, and any combination thereof.

Surfactants suitable as Ingredient 2 can be ionic, nonionic, or mixtures of ionic and nonionic surfactants, and any combination thereof.

The surface-active agents in the compositions of this invention are typically used in the amount from about 0.1 to 40 percent by weight, preferably from about 0.5 to about 20 percent by weight, more preferably from about 1 to about 20 percent by weight.

Preferable surfactants are nonionic surfactants that may be present either on their own or in admixture with the ionic surfactants. Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, alk(en)yl oligoglucosides, fatty acid-N-alkyl glucamides, protein hydrolyzates (more particularly soya-based vegetable products), polyol fatty acid esters, sugar esters, sorbitan esters and polysorbates, and any combination thereof.

Nonionic surfactants include ethylene-oxide condensation surfactants prepared by addition polymerization of ethylene oxide, including ethers such as polyoxyethylene alkyl ethers and polyoxyethylene alkylphenyl ethers; ether esters such as polyethyleneglycerol fatty acid esters; and esters such as polyethyleneglycol fatty acid esters, and any combination thereof; specifically, POE (10) monolaurate, POE (10, 25, 40, 45 or 55) monostearate, POE (21 or 25) lauryl ether, POE (15, 20, 23, 25, 30 or 40) cetyl ether, POE (20) stearyl ether, POE (2, 3, 5, 7, 10, 15, 18 or 20) nonyl phenyl ether wherein POE represents polyoxyethylene and a number in parentheses is a molar number of ethylene oxide added.

Most preferred non-ionic surfactants are polyglycol fatty acid esters available from Nalco company, IL, USA, Tween and SPAN sorbitan fatty acid esters available from Uniqema, NJ, USA, Tergitol primary and secondary alcohol ethoxylates available from Dow Chemical Company, MI, USA.

In at least one embodiment the ionic surfactants are distinguished by a lipophilic, preferably linear alkyl or alkylene group containing 8 to 18 carbon atoms and an ionic group dissociating in water preferably attached terminally thereto. The anionic group may be, for example, a sulfate, sulfonate, phosphate or carboxylate group, and any combination thereof.

The ionic surfactants are preferably anionic surfactants. Typical examples of anionic surfactants are alkyl benzene sulfonates, alkane sulfonates, olefin sulfonates, alkyl ether sulfonates, glycerol ether sulfonates, alpha-methyl ester sulfonates, sulfofatty acids, alkyl sulfates, monoglyceride (ether) sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, acyl lactylates, acyl tartrates, acyl glutamates, acyl aspartates, alkyl oligoglucoside sulfates, protein fatty acid condensates (more particularly wheat-based vegetable products) and alkyl (ether) phosphates, and any combination thereof. If the anionic surfactants contain polyglycol ether chains, they may have a conventional homolog distribution although they preferably have a narrow homolog distribution. Preferred anionic surfactants are alkyl sulfates, fatty alcohol ether sulfates, alkane sulfonates and/or ether carboxylic acids, fatty alcohol ether sulfates being particularly preferred.

Ingredient 3 can be selected from the group of solvatrope or coupling agents such as water and oil miscible organic solvents such as alcohols, ketones, carboxylic acids or esters of carboxylic acids, and any combination thereof. The presence of Ingredient 3 facilitates the emulsion formation when the formulation is added to slurry, it also depresses the freeze point of the composition.

Ingredient 3 can be selected from the group consisting of aliphatic, aliphatic, terpenic, paraffinic, isoparaffinic and olefinic hydrocarbons, alcohols and glycol ethers, and any combination thereof.

It is well known that many coals plants act as "toll" flotation operators processing coal from different mines and stockpiles. The natural differences in coal floatability force the flotation operators to adjust the reagent consumption each time when the coal source changes. In a common case, the operators decrease or increase the flow of the diesel or kerosene collector to their cell. Sometimes, even the highest possible increase of flow rates of the diesel or kerosene collectors cannot make a particular coal to produce acceptable flotation yield and recovery. In at least one embodiment the composition is blended with a hydrocarbon base liquid (such as but not limited to diesel or kerosene) directly on-site. In at least one embodiment a feeding apparatus is constructed and arranged to adjust the mixing ratio in accordance with the consumption requirements of particular coal feed.

EXAMPLES

The foregoing may be better understood by reference to the following examples, which are presented for purposes of illustration and are not intended to limit the scope of the invention.

Figure 2:
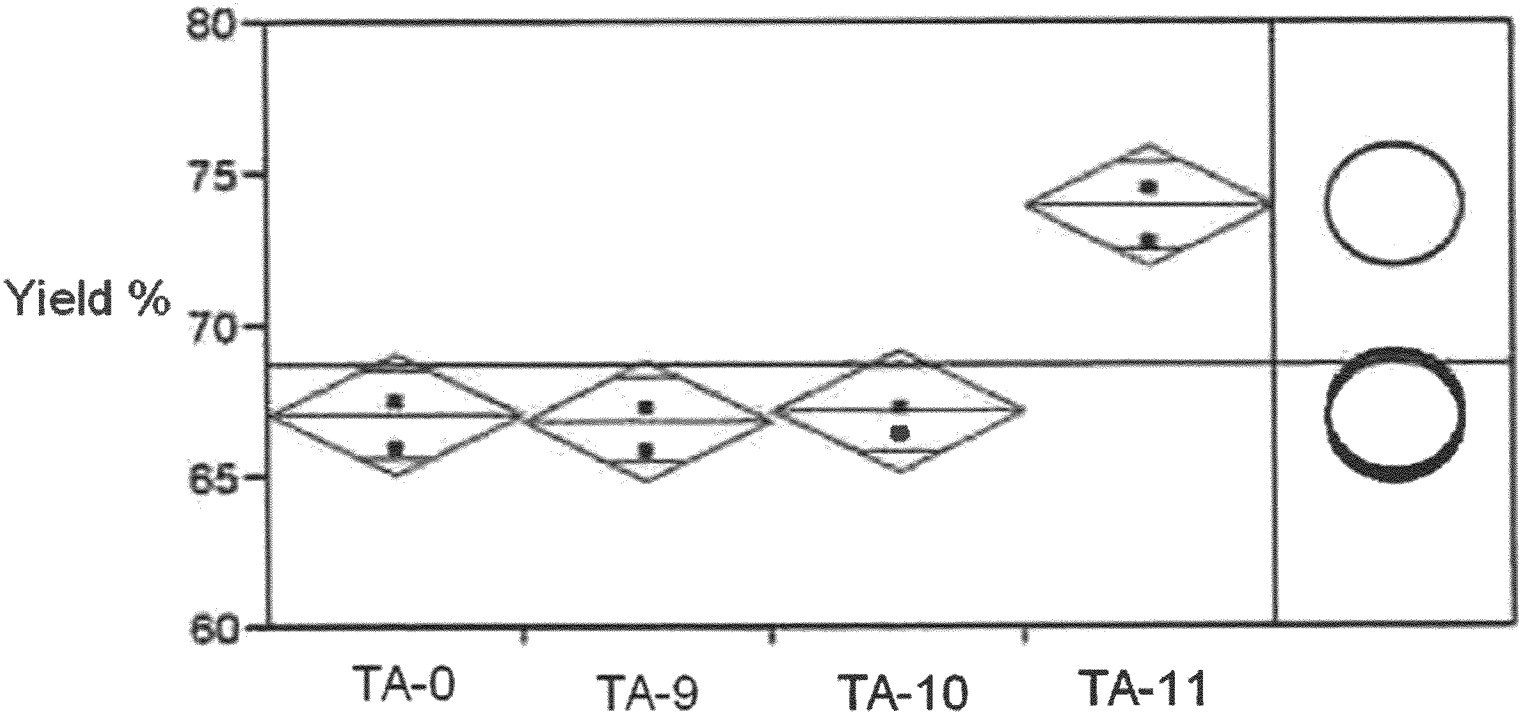
FIG. 2 is chart illustrating the effectiveness of the invention on yield.
Figure 3:
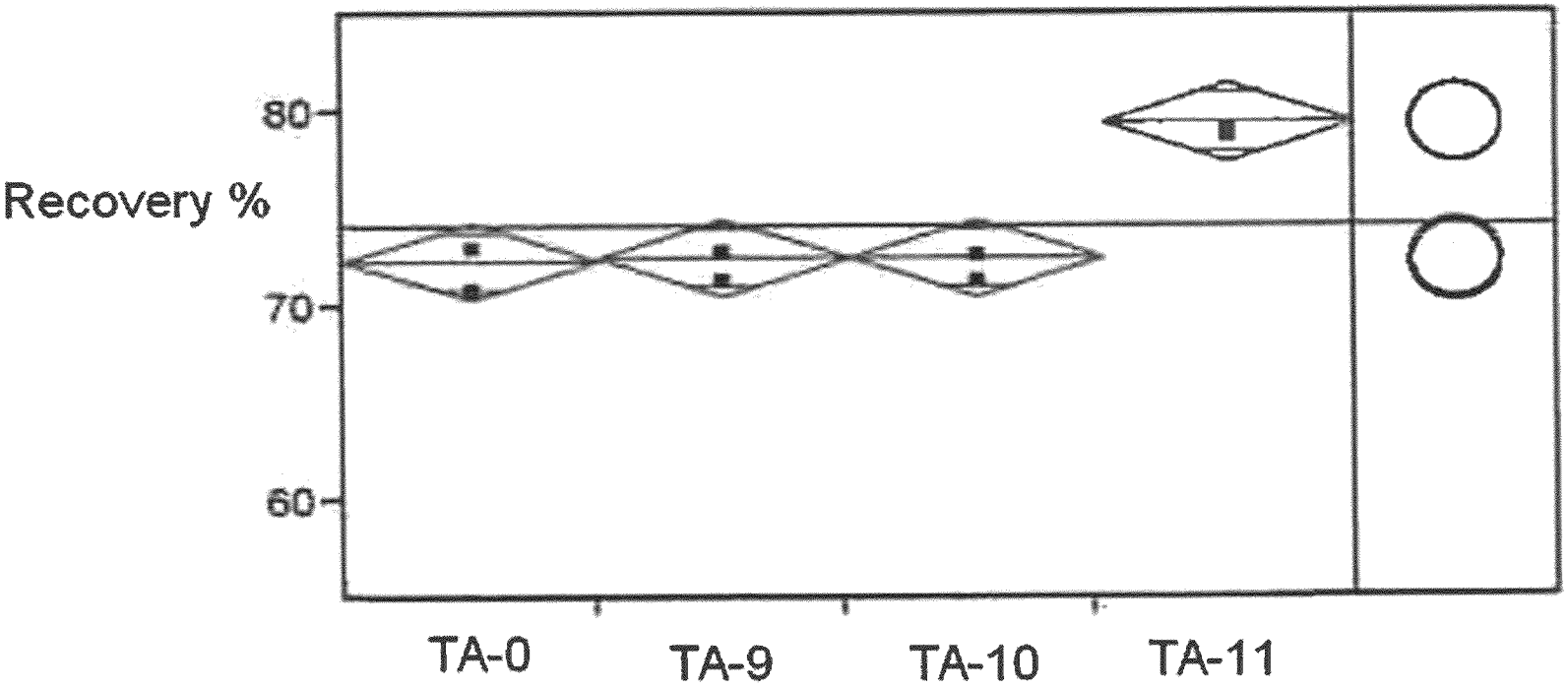
FIG. 3 is chart illustrating the effectiveness of the invention on recovery.
Figure 4:
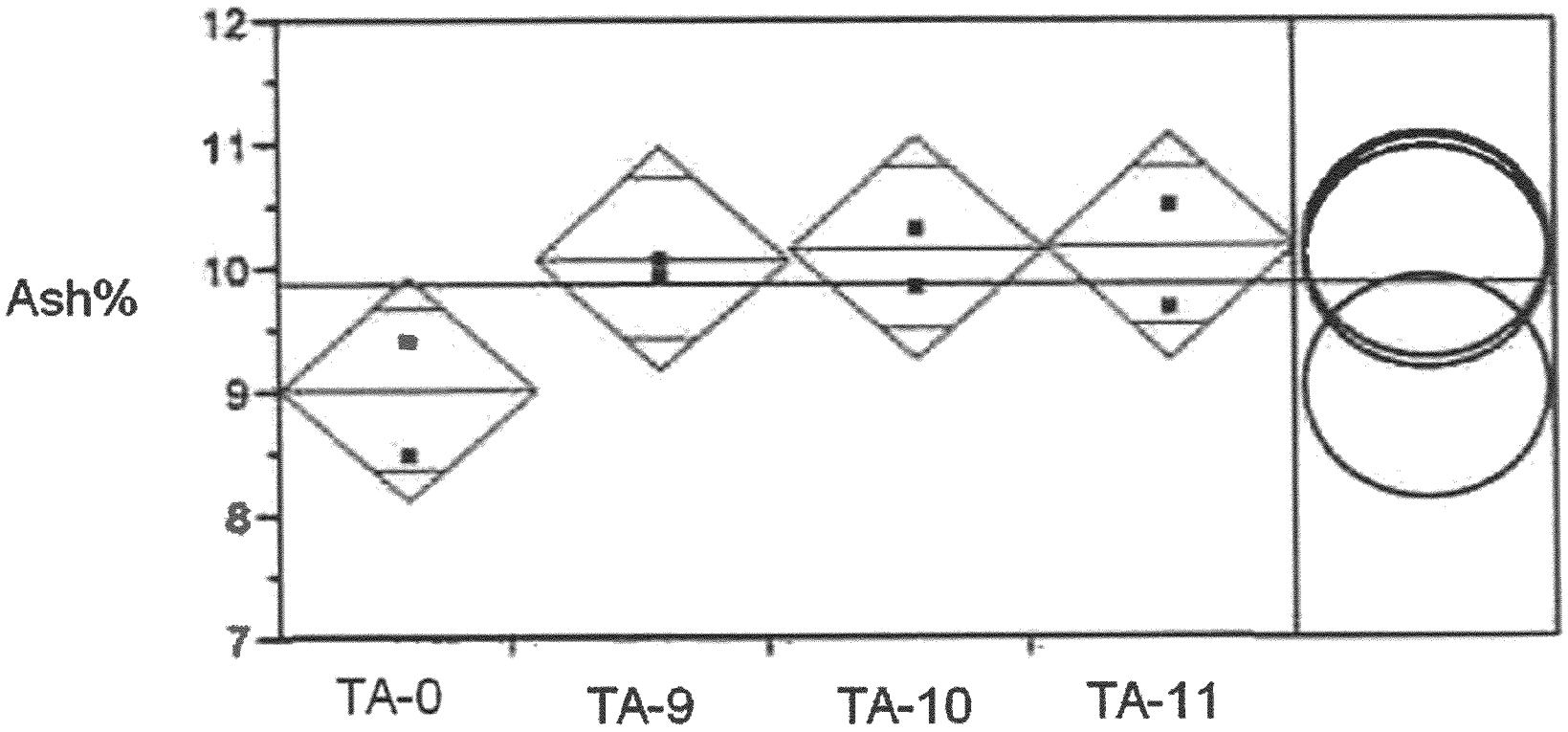
FIG. 4 is chart illustrating the effectiveness of the invention on ash %.

A number of formulations for compositions added to a flotation separation were prepared as listed in Table 1. Comminuted coal ore from a mine in India underwent flotation separation with one of the listed samples added to the slurry. The formulations were added in a ratio of 270 grams per ton of coal. The flotation time was 2.5 minutes. Both the yield of concentrate and the ash resulting from the combustion of the concentrate were measured. Burning of non-flotation separated ore resulted in approximately 31% of the material becoming ash so the degree to which the floated material had ash content below 31% is a measure of the effectiveness of the flotation separation. FIGS. 1, 2, 3, and 4 illustrate the effectiveness of these formulations.

TABLE 1

| Sample Name | % #2 Diesel | % Escaid | % Linseed Oil | % Maleinized Linseed Oil | % C20ASA | % PIBSA Addconate S | % PIBSA Addconate H | % PIBSA Lubrizol 5625 | % Phosphate Ester |
|---|---|---|---|---|---|---|---|---|---|
| TA-0 | 100 | — | — | — | — | — | — | — | — |
| TA-1 | — | 70 | 30 | | — | — | — | — | — |
| TA-2 | — | 70 | — | 30 | — | — | — | — | — |
| TA-3 | — | 70 | — | — | 30 | — | — | — | — |
| TA-4 | — | 70 | — | — | — | — | — | 30 | — |
| TA-5 | — | 70 | 20 | — | — | — | — | — | 10 |
| TA-6 | — | 70 | | 20 | — | — | — | — | 10 |
| TA-7 | — | 70 | — | — | 20 | — | — | — | 10 |
| TA-8 | — | 70 | — | — | — | — | — | 20 | 10 |
| TA-9 | 70 | — | — | — | — | 30 | — | — | — |
| TA-10 | 70 | — | — | — | — | — | 30 | — | — |
| TA-11 | 70 | — | | | — | — | — | 30 | — |

In another example, two formulations for compositions added to a flotation separation were prepared as listed in Table 2.

| Sample Name | % #2 Diesel | % Maleinized Linseed Oil | % Soybean Fatty Acid Methyl Ester | % Straight Run Middle Distillate | % Butanol distillation ends | Yield, % | Ash % | Recovery, % |
|---|---|---|---|---|---|---|---|---|
| TA-0 | 100 | — | — | — | — | 40.6 | 9.3 | 63.6 |
| TA-67 | — | 15 | 80 | — | 5 | 45.0 | 11.1 | 68.4 |
| TA-68 | — | 15 | 40 | 40 | 5 | 45.6 | 11.2 | 68.9 |

Comminuted coal from a North American mine underwent flotation separation with one of the listed samples added to the slurry. The formulations were added in a ratio of 200 grams per ton of coal. The flotation time was 45 seconds. Both the yield of concentrate and the ash resulting from the combustion of the concentrate were measured. The recovery of the flotation concentrate floated using Diesel #2 was 63.6%, which increased up to 68.4% and 68.9% when the products of the instant invention were utilized.

The results of the examples demonstrate that that the inventive compositions are at least as effective in facilitating coal flotation as is diesel and in some cases better. The results also indicate that diesel can be diluted with one or more of the ingredients without loss of effectiveness. This means that a user can adjust the ratio of diesel or other material based on such conditions as performance to a specific sample of ore having specific properties, cost and/or availability. The low ash content of the results indicates that not only do the formulations effect flotation separation of significant mass of the slurry, but that the separation is properly selecting for coal and not for combustible materials in the slurry.

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of enhancing the performance of a froth flotation separation of a coal slurry in a medium, the method comprising the steps of:

adding to the coal slurry a composition, the composition comprising a hydrophobic reaction product, a surfactant, and optionally a diluent and optionally a coupling agent, wherein the hydrophobic reaction product is the reaction of an unsaturated mono- and polycarboxylic acids, their anhydrides, acyl halides, salts, esters or blends thereof with at least one olefin polymer with a molecular weight in the range of from about 400 to 10,000 Daltons, and removing a concentrate from the slurry by sparging the slurry.

2. The method of claim 1 in which at least one olefin polymer is one selected from the list consisting of: any isomer of ethylene, propylene, 1-butene, 2-butene, isobutene, pentenes, hexenes and heptenes, and any combination thereof.

3. The method of claim 1 in which the at least one olefin polymer is polyisobutenyl succinic anhydrides.

4. The method of claim 1 in which the surfactant is one selected from the list consisting of: fatty alcohol polyglycol ethers, alkylphenol polyglycol ethers, fatty acid polyglycol esters, fatty acid amide polyglycol ethers, fatty amine polyglycol ethers, alkoxylated triglycerides, alk(en)yl oligoglucosides, fatty acid-N-alkyl glucamides, protein hydrolyzates (more particularly soya-based vegetable products), polyol fatty acid esters, sugar esters, sorbitan esters and polysorbates, polyoxyethylene alkyl ethers, polyoxyethylene alkylphenyl ethers, ether esters, polyethyleneglycerol fatty acid esters; polyethyleneglycol fatty acid esters, and any combination thereof.

5. The method of claim 1 in which the diluent or coupling agent is one item selected from the group consisting of: of solvatropes, coupling agents, water and oil miscible organic solvents, alcohols, ketones, carboxylic acids, esters of carboxylic acids, aliphatic, aromatic, terpenic, paraffinic, isoparaffinic and olefinic hydrocarbons, alcohols and glycol ethers, and any combination thereof.

6. The method of claim 1 further comprising the steps of:

mixing the composition with a base liquid in a manner that forms a desired ratio of composition to base liquid, prior to adding it to slurry, measuring the rate of the concentrate removal, and adjusting the ratio to increase the rate of the concentrate removal.

* * * * *